United States Patent [19]

Diamond

[11] Patent Number: 4,890,632

[45] Date of Patent: Jan. 2, 1990

[54] ROTATABLE SMOKELESS ASHTRAY

[75] Inventor: Israel Diamond, Franklin Square, N.Y.

[73] Assignee: Merchandising Display Corporation, Englewood, N.J.

[21] Appl. No.: 223,894

[22] Filed: Jul. 21, 1988

[51] Int. Cl.[4] ..... A24F 19/08

[52] U.S. Cl. ..... 131/237; 131/235.1; 131/231

[58] Field of Search ..... 131/235.1, 231, 237, 131/236; D27/102, 125, 127, 133

[56] References Cited

U.S. PATENT DOCUMENTS

| | | | |
|---|---|---|---|
| 1,780,258 | 11/1930 | Weinberg | 131/235.1 |
| 2,518,849 | 8/1950 | Agee | 131/235.1 |
| 2,642,310 | 6/1953 | Meek et al. | 131/231 X |
| 2,657,090 | 10/1953 | Meek . | |
| 3,620,225 | 11/1971 | Bailey | 131/235.1 |

FOREIGN PATENT DOCUMENTS

| | | | |
|---|---|---|---|
| 505573 | 9/1954 | Canada | 131/237 |
| 2062964 | 7/1972 | Fed. Rep. of Germany | 131/237 |

*Primary Examiner*—V. Millin
*Assistant Examiner*—D. F. Crosby
*Attorney, Agent, or Firm*—Natter & Natter

[57] ABSTRACT

A low cost smokeless ashtray includes an upper, generally cylindrical receptacle having a bottom panel with a pair of selectively closeable apertures. Extending downwardly from the center of the bottom panel is a unitary journal having a radially projecting key. The receptacle is rotatably mounted to a base with the journal extending through a keyed orifice. The base includes an upper planar bearing plate having a pair of butt receiving wells. The wells are accessed by rotating the receptacle relative to the base until the bottom panel apertures are registered with the wells. The receptacle and base are each preferably molded in one piece construction of a suitable thermosetting polymer such as an amino resin, for example, a melamine molding compound with an alpha cellulose filler.

14 Claims, 1 Drawing Sheet

ROTATABLE SMOKELESS ASHTRAY

BACKGROUND OF THE INVENTION

1. Field of the Invention

This invention relates generally to smokeless ashtrays and more particularly to ashtrays having closeable wells for receiving cigarette butts.

2. Related Art

The significance of ashtrays for the purpose of reducing litter and maintaining a clean environment has been recognized throughout the years. While most prior ashtrays have provided a convenient receptacle for resting a cigarette, cigar, or pipe and for discarding the butt, or ashes, attempts at providing improved butt and ash storage capabilities and reducing the generation of smoke have not been readily accepted.

Prior approaches at providing a storage compartment beneath an ashtray result in relatively complex ashtray mechanisms which included springs and levers. Typical examples of these prior devices were illustrated in U.S. Pat. No. 2,518,849 issued Aug. 15, 1950 to Agee and U.S. Pat. No. 1,780,258 issued Nov. 4, 1930 to Weinberg. Such devices were indeed difficult to use and also to empty and clean. Further, due to their complex nature, were relatively costly as compared with ordinary ashtrays. The need remained for a low cost relatively simple ashtray having a coverable receptacle for smokeless storage of butts and smoldering ashes.

SUMMARY OF THE INVENTION

A simple, low cost smokeless ashtray is formed of two components each constituting unitarily molded pieces. The ashtray includes an upper receptacle which is configured in a generally cylindrical shape and includes an annular bottom panel. The receptacle is rotatably mounted to a base having a planar bearing surface with a central orifice having a radial keyway. A journal extends downwardly from the receptacle into the orifice for rotatably mounting the receptacle to the base. When the key of the journal is registered with the orifice keyway, the receptacle may be lifted from the base to disassemble the ashtray for cleaning. The bottom panel of the receptacle includes a plurality of spaced apertures and the planar bearing plate of the base includes a like plurality of depressions or wells suitable for receiving ashes and butts.

When a user desires to discard a butt or dispose of ashes, the receptacle is rotated until the receptacle bottom panel apertures are registered with the wells in the base; the butt or ashes are then deposited in the wells. Thereafter, the receptacle is again rotated to cover the wells with the lower surface of the bottom panel and simultaneously register the apertures with the bearing plate of the base. In such position, smoke from smoldering ashes or butts cannot escape the wells and the receptacle presents a tidy appearance.

From the foregoing compendium, it will be appreciated that it is an aspect of the present invention to provide a smokeless ashtray of the general character described which is not subject to the disadvantages of the background art aforementioned.

It is a further aspect of the present invention to provide a smokeless ashtray of the general character described which is relatively simple in construction.

A consideration of the present invention is to provide a smokeless ashtray of the general character described which is well suited for low cost economical mass production fabrication.

A further consideration of the present invention is to provide a smokeless ashtray of the general character described which occupies but a modicum of space and is thus well suited for placement on small tables in restaurants and bars.

It is a feature of the present invention to provide a smokeless ashtray of the general character described which may be easily disassembled and assembled for cleaning purposes.

Yet another feature of the invention is to provide a smokeless ashtray of the general character described which effectively precludes the discharge of smoke from discarded cigarettes.

Another consideration of the present invention is to provide a smokeless ashtray of the general character described which is well suited for promotional purposes.

A still further feature of the present invention is to provide a smokeless ashtray of the general character described which is relatively sturdy in construction and configured to withstand the rigors of extended usage.

Other aspects, features and considerations of the present invention in part will be obvious and in part will be pointed out hereinafter.

With these ends in view, the invention finds embodiment in certain combinations of elements, arrangements of parts, and series of steps by which the aspects, features and considerations aforementioned and certain other aspects, features and considerations are hereinafter attained, all as fully described with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention.

DESCRIPTION OF THE PREFERRED EMBODIMENT

Figure 1:
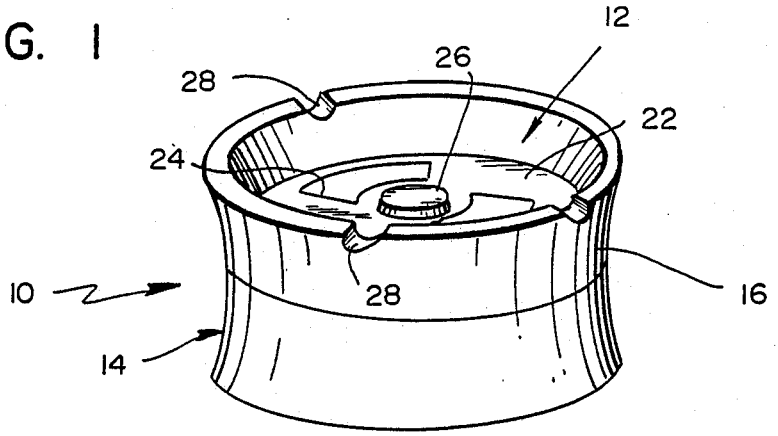
FIG. 1 is a perspective illustration of a smokeless ashtray constructed in accordance with and embodying the present invention and showing an upper receptacle rotatably mounted to a base.

Referring now in detail to the drawings, the reference numeral 10 denotes generally a smokeless rotatable ashtray constructed in accordance with and embodying the invention. The ashtray 10 comprises an upper generally cylindrical receptacle 12 which is rotatably mounted to a mating base 14. As will be readily observed from FIGS. 1 and 3, the receptacle 12 includes an upwardly sloping annular side skirt 16 having its major diameter at an upper edge 18 and its minor diameter at a generally planar bottom surface 20.

The bottom surface 20 is formed as the lower surface of a bottom panel 22. The panel 22 includes a pair of symetrically positioned diametrically opposed apertures 24. In addition, a central hub 26 projects upwardly from the panel 22 and provides a convenient surface for extinguishing cigarettes. It should also be noted that the skirt 16 may include a plurality of notches 28 symetrically positioned along the upper edge 18 for the convenience of resting a cigarette.

Figure 3:
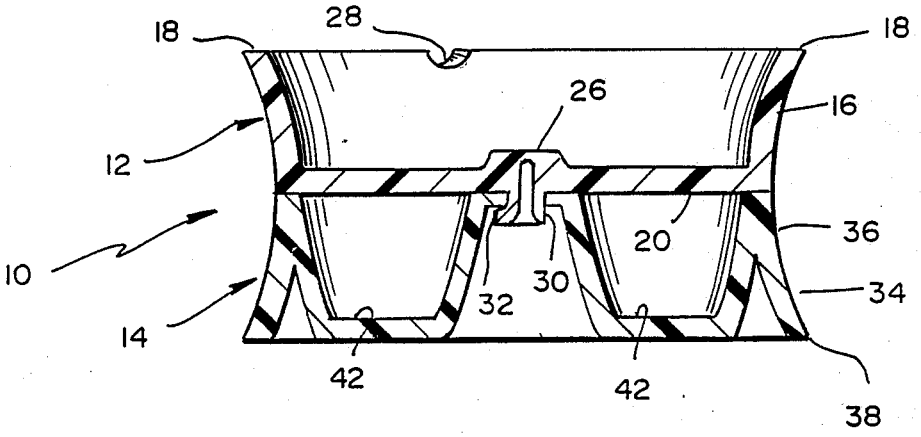
FIG. 3 is an enlarged scale sectional view through the ashtray, the same being taken substantially along the line 3—3 of FIG. 2 and showing a pair of wells formed in the base and a journal which extends from the receptacle into an orifice of the base for rotatably mounting the receptacle to the base.

Referring now to FIG. 3, it will be seen that a cylindrical journal 30 extends from the center of the receptacle downwardly beneath the bottom surface 20. The journal 30 includes a radially projecting key 32. It should also be noted that the upwardly projecting hub 26 is formed in conjunction with the journal 30 when the receptacle is molded as a single piece. The hub 26 provides structural support for the journal 30 which may include a hollow interior formed by a core during molding.

Turning now to the base 14 about which the receptacle rotates as illustrated in FIGS. 1 and 3, the base includes a generally cylindrical skirt 34 which is downwardly outwardly curved. The skirt 34 is formed with a minor diameter at its upper periphery 36 and a major diameter at its lower periphery 38. In order to present a pleasing symmetrical appearance it should be appreciated that the minor and major diameters of the receptacle and base coincide.

Figure 2:
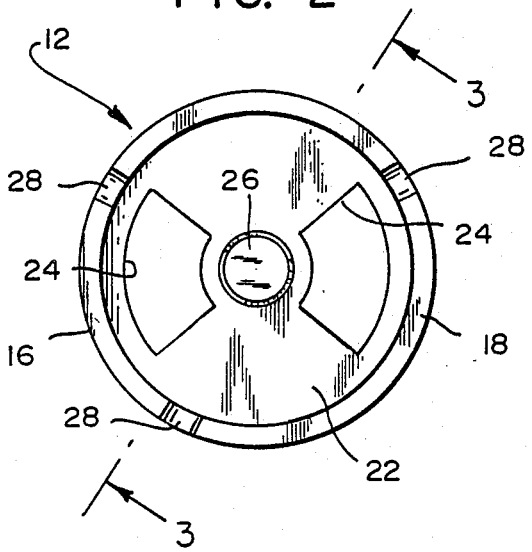
FIG. 2 is a reduced scale top plan view of the ashtray and showing the receptacle including a bottom panel having a pair of apertures and a central hub.
Figure 4:
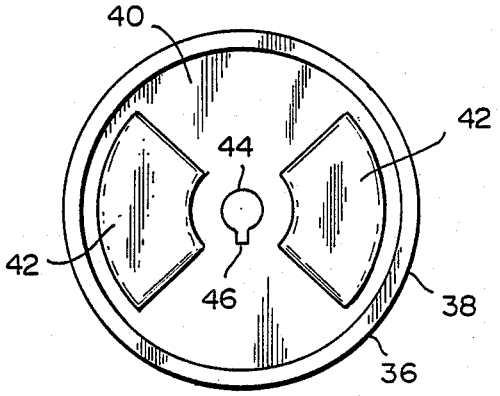
FIG. 4 is a reduced scale top plan view of the base, with the receptacle removed, and showing an upper bearing plate and the wells formed in the plate.

As previously mentioned, the base 14 includes a generally planar upper bearing plate 40. The bearing plate 40 is formed with a pair of spaced diametrically opposed wells 42. It will be seen from a comparison of FIGS. 2 and 4, that the wells 42 are of larger dimension than the apertures 24 to permit easy access for cleaning and also to assure that an adequate area of the planar surface 20 of the bottom panel 22 is provided for sealing the wells 24 to prevent the escape of smoke.

It should also be noted that a central orifice 44 is provided through the bearing plate 40. The orifice 44 is circular in configuration except for a radially projecting keyway 46. With attention again directed to FIG. 3, it will be observed that the key 32 of the journal 30 is adapted to be received through the orifice keyway 46 after which the receptacle 12 will freely rotate about the base with the bearing plate 40 in engagement with the planar bottom surface 20 of the receptacle.

In order to disassemble the ashtray 10 for the purpose of cleaning, the receptacle 12 is rotated relative to the base 14 while the components are gently urged apart. Upon registration of the key 32 with the keyway 46, the components will separate and the open wells 42 may be accessed for dumping the contents and cleaning.

As previously mentioned, the receptacle 12 as well as the base 14 may each be preferably molded in one piece construction of a suitable thermosetting polymer resin. Typical resins suitable for use in conjunction with the present invention include amino resins such as melamine molding compounds which are generally produced with alpha cellulose filer. Such molding compounds are well suited for compression molding in an unlimited range of colors and provide a sturdy ashtray structure which is not subject to breakage if, for example, dropped from a table.

It should be appreciated that the present invention provides for sanitary disposal of discarded smoker's articles. The receptacle is maintained generally free of butts and ashes while smoke and odors from smoldering ashes or butts is precluded. Thus the ashtray 10 is well suited for a restaurant environment.

In addition, because the contents of the base are concealed from view, the base need not be emptied after each patron leaves. Thorough cleansing is a simple task. A waitress separates the receptacle from the base and empties the contents from the wells 42 as previously described. Since both the receptacle and base are of one piece of molded plastic, they may be washed in a sink or dishwasher at the end of the day or more frequently if desired.

Thus it will be seen that there is provided a smokeless ashtray of the general character described which achieves the various aspects, features and considerations of the present invention and which is well suited to meet the conditions of practical usage.

As various possible embodiments might be made of the present invention and as various changes might be made in the exemplary embodiment herein set forth, it is to be understood that all matter herein described and shown in the accompanying drawings is to be interpreted as illustrative and not in a limiting sense.

Having thus described the invention there is claimed as new and desired to be secured by Letters Patent:

1. A two component rotatable smokeless ashtray for receiving and containing discarded smoker's materials, the ashtray comprising a base component and a receptacle component including means for supporting a smoker's article, the base component including an upper bearing plate, means forming an opening in the contour of the plate for receiving discarded smoker's materials, the receptacle including a bottom surface, the bottom surface substantially conforming in contour with the bearing plate, the bottom surface of the receptacle abutting the bearing plate, one of the components including journal means interconnecting the components for rotation about an axis, the journal means including means for preventing separation of the components except in a selected position of relative rotation of the components, the other component including means forming an orifice concentric with the rotation axis, the orifice receiving the journal means, the bottom surface including an aperture, the aperture and opening being spaced from the orifice and being registered with one another in at least one position of relative rotation of the components whereby access to the base for depositing smoker's materials is provided through the aperture, the bottom surface of the receptacle sealing the opening in at least one other position of relative rotation of the components whereby the deposited smoker's materials are sealed within the base, each component being formed of one piece unitary molded construction.

2. A two component rotatable smokeless ashtray for receiving and containing discarded smoker's materials, the ashtray comprising a base component and a receptacle component, the base component including an upper bearing plate, means forming an opening in the contour of the plate for receiving discarded smoker's materials, the receptacle including a bottom surface, the bottom surface substantially conforming in contour with the bearing plate, the bottom surface of the receptacle abutting the bearing plate, one of the components including journal means interconnecting the components for rotation about an axis, the bottom surface including an aperture, the aperture and opening being spaced from the rotation axis and being registered with one another in at least one position of relative rotation of the components whereby access to the base for depositing smoker's materials is provided through the aperture, the bottom surface of the receptacle sealing the opening in at least one other position of relative rotation of the components whereby the deposited smoker's materials are sealed within the base, each component being formed of one piece unitary molded construction, means preventing inadvertent separation of components, the preventing means including means forming a key in the journal means, the ashtray further including means forming an orifice in the other component, the journal means being seated in the orifice, the preventing means further including means forming a keyway in the orifice, the journal means being rotatable within the orifice, the components being separable when the key is registered with the keyway.

3. A two component rotatable smokeless ashtray constructed in accordance with claim 1 wherein the one component comprises the receptacle.

4. A two component rotatable smokeless ashtray constructed in accordance with claim 1 wherein the receptacle includes a peripheral wall and a bottom panel, the bottom panel including the bottom surface.

5. A two component rotatable smokeless ashtray constructed in accordance with claim 1 wherein the opening in the contour of the plate comprises means forming a depression in the surface of the plate.

6. A two component rotatable smokeless ashtray constructed in accordance with claim 1 wherein a plurality of openings are provided in the plate and a like plurality of apertures are provided in the bottom surface.

7. A two component rotatable smokeless ashtray constructed in accordance with claim 1 wherein the components are molded of melamine.

8. A two piece rotatable smokeless molded ashtray constructed in accordance with claim 7 wherein the components are compression molded.

9. A two piece rotatable smokeless ashtray constructed in accordance with claim 1 wherein the receptacle includes a peripheral wall, the means for a supporting smoker's article comprising means forming a cigarette rest in the wall, the cigarette rest comprising a notch.

10. A two component rotatable smokeless ashtray constructed in accordance with claim 1 wherein the receptacle includes a peripheral wall and a bottom panel, the bottom panel including the bottom surface, the one component comprising the receptacle, the receptacle further including a raised hub in the bottom panel, the raised hub having a generally planar upper surface, the raised hub being coaxial with the journal whereby an ashtray of increased durability is provided.

11. A two component rotatable smokeless ashtray constructed in accordance with claim 1 wherein the aperture is of smaller dimensions than the opening, whereby the discarded smoker's materials may be easily emptied from the base upon separation of the components.

12. A method of sanitary disposal of discarded smoker's materials suitable for an environment where food is consumed or prepared, the method comprising the steps of:

(a) providing a two component rotatable smokeless ashtray constructed in accordance with claim 1,
(b) rotating the components relative to one another until they are in the one position wherein the aperture and the opening are registered,
(c) depositing the smoker's materials in the base, and
(d) rotating the components relative to one another until they are in the other position wherein the smoker's materials are sealed within the base.

13. A method of sanitary disposal of discarded smoker's materials in accordance with claim 12 wherein the other component includes means forming an orifice, the journal means being rotatably seated in the orifice, the ashtray further including means preventing inadvertent separation of components, the preventing means including a key formed in the journal and a keyway formed in the orifice, the components being separable when the key is registered with the keyway, the method further including the steps of:

(e) rotating the components relative to one another until the key is registered with the keyway,
(f) separating the components by urging them apart,
(g) emptying the discarded smoker's materials from the base by inverting the base.

14. A method as constructed in accordance with claim 13 further including the steps of:

(h) cleaning the base, and
(i) reassembling the components by registering the key with the keyway, urging the components together and rotating the components relative to one another.

* * * * *